US006984480B2

(12) United States Patent
Vanbesien et al.

(10) Patent No.: US 6,984,480 B2
(45) **Date of Patent: *Jan. 10, 2006**

(54) TONER PROCESSES

(75) Inventors: Daryl Vanbesien, Burlington (CA); Michael A. Hopper, Toronto (CA); Raj D. Patel, Oakville (CA)

(73) Assignee: Xerox Corporation, Stamford, CT (US)

( * ) Notice: Subject to any disclaimer, the term of this patent is extended or adjusted under 35 U.S.C. 154(b) by 138 days.

This patent is subject to a terminal disclaimer.

(21) Appl. No.: 10/603,449

(22) Filed: Jun. 25, 2003

(65) Prior Publication Data

US 2004/0265727 A1 Dec. 30, 2004

(51) Int. Cl.
*G03G 9/08* (2006.01)

(52) U.S. Cl. ..... 430/137.1; 430/137.14
(58) Field of Classification Search ..... 430/137.1, 430/137.14
See application file for complete search history.

(56) References Cited

U.S. PATENT DOCUMENTS

| | | | | |
|---|---|---|---|---|
| 5,290,654 A | | 3/1994 | Sacripante et al. | 430/137 |
| 5,910,387 A | | 6/1999 | Mychajlowskij et al. | 430/110 |
| 5,916,725 A | | 6/1999 | Patel et al. | 430/137 |
| 5,919,595 A | | 7/1999 | Mychajlowskij et al. | 430/137 |
| 5,922,501 A | | 7/1999 | Cheng et al. | 430/137 |
| 5,925,488 A | | 7/1999 | Patel et al. | 430/137 |
| 5,945,245 A | | 8/1999 | Mychajlowskij et al. | 430/137 |
| 5,977,210 A | | 11/1999 | Patel et al. | 523/161 |
| 5,994,020 A | | 11/1999 | Patel et al. | 430/137 |
| 6,132,924 A | | 10/2000 | Patel et al. | 430/137 |
| 6,268,102 B1 | * | 7/2001 | Hopper et al. | 430/137.14 |
| 6,416,920 B1 | | 7/2002 | Hopper et al. | 430/137.14 |
| 6,495,302 B1 | | 12/2002 | Jiang et al. | 430/137.14 |
| 6,500,597 B1 | | 12/2002 | Patel et al. | 430/137.14 |
| 6,541,175 B1 | | 4/2003 | Jiang et al. | 430/137.14 |
| 6,576,389 B2 | | 6/2003 | Vanbesien et al. | 430/137.14 |
| 6,767,684 B1 | * | 7/2004 | Patel et al. | 430/137.14 |

* cited by examiner

*Primary Examiner*—John L Goodrow
(74) *Attorney, Agent, or Firm*—E. O. Palazzo

(57) ABSTRACT

A process comprising heating a mixture of colorant and latex in the presence of a coagulant and a silicate salt, and wherein said heating comprises a first heating equal to or below about the glass transition temperature of a polymer contained in said latex, and a second heating equal to or about the glass transition temperature of a polymer contained in said latex; wherein said first heating enables the formation of aggregates and said second heating enables the fusion of said colorant and said polymer; and optionally wherein said silicate is contained in an alkali metal hydroxide.

32 Claims, No Drawings

TONER PROCESSES

RELATED APPLICATIONS AND PATENTS

Illustrated in copending application U.S. Ser. No. 10/606,330, U.S. Publication No. 2004/0265728, filed concurrently herewith, the disclosure of which is totally incorporated herein by reference, is a toner process comprised of heating a mixture of an acicular magnetite dispersion, a colorant dispersion, a wax dispersion, a first latex containing a crosslinked resin, and a second latex containing a resin free of crosslinking in the presence of a coagulant to provide aggregates, stabilizing the aggregates with a silicate salt dissolved in a base, and further heating the aggregates to provide coalesced toner particles.

Illustrated in copending application U.S. Ser. No. 10/606,298, filed concurrently herewith, the disclosure of which is totally incorporated herein by reference, is a toner process comprised of a first heating of a mixture of an aqueous colorant dispersion, an aqueous latex emulsion, and an aqueous wax dispersion in the presence of a coagulant to provide aggregates, adding a base followed by adding an organic sequestering agent, and thereafter accomplishing a second heating, and wherein the first heating is below about the latex polymer glass transition temperature (Tg), and the second heating is about above the latex polymer glass transition temperature.

Illustrated in copending application U.S. Ser. No. 10/603,321, U.S. Publication No. 2004/0265729, filed concurrently herewith, the disclosure of which is totally incorporated herein by reference, is a toner process comprised of heating a mixture of an acicular magnetite dispersion, a colorant dispersion, a wax dispersion, a first latex containing a crosslinked resin, a second latex containing a resin substantially free of crosslinking, a coagulant and a silica, and wherein the toner resulting possesses a shape factor of from about 120 to about 150.

Illustrated in U.S. Pat. No. 6,576,389, filed Oct. 15, 2001 on Toner Coagulant Processes, the disclosure of which is totally incorporated herein by reference, is a process for the preparation of toner comprising mixing a colorant dispersion, a latex emulsion, a wax dispersion and coagulants comprising a colloidal alumina coated silica, and a polymetal halide.

The appropriate components, such as for example, waxes, coagulants, resin latexes, surfactants, and colorants, and processes of the above copending applications may be selected for the present invention in embodiments thereof.

BACKGROUND

This invention relates to toner processes, and more specifically, to aggregation and coalescence processes. Yet, more specifically, the present invention relates in embodiments to methods for the preparation of toner compositions by a chemical process, such as emulsion aggregation, wherein latex particles are aggregated with a wax and colorants, in the presence of a coagulant like a polymetal halide, thereafter stabilizing the aggregates with a solution of an alkali silicate, such as sodium silicate dissolved in a base such as sodium hydroxide, and thereafter coalescing or fusing by heating the mixture above the resin Tg to provide toner size particles.

A number of advantages are associated with the present invention in embodiments thereof including, for example, obtaining excellent hot toner offset, for example about 210° C., and a fusing latitude of from about 30 to about 45° C., wherein fusing latitude refers, for example, to a temperature in which, when a developed image is fused, evidences substantially no offset either to the substrate that the image is fused on, referred to as "Cold" offset or offset on the fuser roll referred as the "HOT" offset; a toners minimum fixing temperature of about 60 to about 80 ggu at a temperature of, for example, about 160° C. to about 180° C., to thereby extend photoreceptor life since the toner fusing temperature can be below about 200° C., such as from about 160° C. to about 180° C.

REFERENCES

In U.S. Pat. No. 6,132,924, the disclosure of which is totally incorporated herein by reference, there is illustrated a process for the preparation of toner comprising mixing a colorant a latex, and a coagulant, followed by aggregation and coalescence, wherein the coagulant may be a polyaluminum chloride.

In U.S. Pat. No. 6,268,102, the disclosure of which is totally incorporated herein by reference, there is illustrated a process for the preparation of toner comprising mixing a colorant a latex, and a coagulant, followed by aggregation and coalescence, wherein the coagulant may be a polyaluminum sulfosilicate.

In U.S. Pat. No. 6,132,924, the disclosure of which is totally incorporated herein by reference, there is illustrated a process for the preparation of toner comprising mixing a colorant, a latex, and two coagulants, followed by aggregation and coalescence, and wherein one of the coagulants may be polyaluminum chloride.

Illustrated in U.S. Pat. No. 5,994,020, the disclosure of which is totally incorporated herein by reference, are toner preparation processes, and more specifically, a process for the preparation of toner comprising:

(i) preparing, or providing a colorant dispersion;

(ii) preparing, or providing a functionalized wax dispersion comprised of a functionalized wax contained in a dispersant mixture comprised of a nonionic surfactant, an ionic surfactant, or mixtures thereof;

(iii) shearing the resulting mixture of the functionalized wax dispersion (ii) and the colorant dispersion (i) with a latex or emulsion blend comprised of resin contained in a mixture of an anionic surfactant and a nonionic surfactant;

(iv) heating the resulting sheared blend of (iii) below about the glass transition temperature (Tg) of the resin particles;

(v) optionally adding additional anionic surfactant to the resulting aggregated suspension of (iv) to prevent, or minimize additional particle growth of the resulting electrostatically bound toner size aggregates during coalescence (iv);

(vi) heating the resulting mixture of (v) above about the Tg of the resin; and optionally, (vii) separating the toner particles; and a process for the preparation of toner comprising blending a latex emulsion containing resin, colorant, and a polymeric additive; adding an acid to achieve a pH of about 2 to about 4 for the resulting mixture; heating at a temperature about equal to, or about below the glass transition temperature (Tg) of the latex resin; optionally adding an ionic surfactant stabilizer; heating at a temperature about equal to, or about above about the Tg of the latex resin; and optionally cooling, isolating, washing, and drying the toner.

Illustrated in U.S. Pat. No. 6,541,175, the disclosure of which is totally incorporated herein by reference, is a process comprising:

(i) providing or generating an emulsion latex comprised of sodio sulfonated polyester resin particles by heating the particles in water at a temperature of from about 65° C. to about 90° C.;

(ii) adding with shearing to the latex (i) a colorant dispersion comprising from about 20 percent to about 50 percent of a predispersed colorant in water, followed by the addition of an organic or an inorganic acid;

(iii) heating the resulting mixture at a temperature of from about 45° C. to about 65° C. followed by the addition of a water insoluble metal salt or a water insoluble metal oxide thereby releasing metal ions and permitting aggregation and coalescence, optionally resulting in toner particles of from about 2 to about 25 microns in volume average diameter; and optionally (iv) cooling the mixture and isolating the product.

Also of interest is U.S. Pat. No. 6,416,920, the disclosure of which is totally incorporated herein by reference, which illustrates a process for the preparation of toner comprising mixing a colorant, a latex, and a silica, which silica is coated with an alumina.

Illustrated in U.S. Pat. No. 6,495,302, the disclosure of which is totally incorporated herein by reference, is a process for the preparation of toner comprising (i) generating a latex emulsion of resin, water, and an ionic surfactant, and a colorant dispersion of a pigment, water, an ionic surfactant, or a nonionic surfactant, and wherein (ii) the latex emulsion is blended with the colorant dispersion;

(iii) adding to the resulting blend containing the latex and colorant a coagulant of a polyaluminum chloride with an opposite charge to that of the ionic surfactant latex colorant;

(iv) heating the resulting mixture below or equal to about the glass transition temperature (Tg) of the latex resin to form aggregates;

(v) optionally adding a second latex comprised of submicron resin particles suspended in an aqueous phase (iv) resulting in a shell or coating wherein the shell is optionally of from about 0.1 to about 1 micron in thickness, and wherein optionally the shell coating is contained on 100 percent of the aggregates;

(vi) adding an organic water soluble or water insoluble chelating component to the aggregates of (v) particles, followed by adding a base to change the resulting toner aggregate mixture from a pH which is initially from about 1.9 to about 3 to a pH of about 5 to about 9;

(vii) heating the resulting aggregate suspension of (vi) above about the Tg of the latex resin;

(viii) optionally retaining the mixture (vii) at a temperature of from about 70° C. to about 95° C.;

(ix) changing the pH of the (viii) mixture by the addition of an acid to arrive at a pH of about 1.7 to about 4; and (x) optionally isolating the toner.

Illustrated in U.S. Pat. No. 6,500,597, the disclosure of which is totally incorporated herein by reference, is a process comprising (i) blending a colorant dispersion of a pigment, water, and an anionic surfactant, or a nonionic surfactant with (ii) a latex emulsion comprised of resin, water, and an ionic surfactant;

(iii) adding to the resulting blend a first coagulant of polyaluminum sulfosilicate (PASS) and a second cationic co-coagulant having an opposite charge polarity to that of the latex surfactant;

(iv) heating the resulting mixture below about the glass transition temperature (Tg) of the latex resin;

(v) adjusting with a base the pH of the resulting toner aggregate mixture from a pH which is in the range of about 1.8 to about 3 to a pH range of about 5 to about 9;

(vi) heating above about the Tg of the latex resin;

(vii) changing the pH of the mixture by the addition of a metal salt to arrive at a pH of from about 2.8 to about 5; and (viii) optionally isolating the product.

Emulsion/aggregation/coalescing processes for the preparation of toners are illustrated in a number of Xerox patents, the disclosures of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,650,256 and 5,501,935; 5,723,253; 5,744,520; 5,763,133; 5,766,818; 5,747,215; 5,827,633; 5,853,944; 5,804,349; 5,840,462; 5,869,215; 5,869,215; 5,863,698; 5,902,710; 5,910,387; 5,916,725; 5,919,595; 5,925,488 and 5,977,210. The components and processes of the Xerox patents can be selected for the present invention in embodiments thereof.

In addition, the following U.S. Patents relate to emulsion aggregation toner processes, the disclosures of which is totally incorporated herein by reference.

U.S. Pat. No. 5,922,501, the disclosure of which is totally incorporated herein by reference, illustrates a process for the preparation of toner comprising blending an aqueous colorant dispersion and a latex resin emulsion, and which latex resin is generated from a dimeric acrylic acid, an oligomer acrylic acid, or mixtures thereof and a monomer; heating the resulting mixture at a temperature about equal, or below about the glass transition temperature (Tg) of the latex resin to form aggregates; heating the resulting aggregates at a temperature about equal to, or above about the Tg of the latex resin to effect coalescence and fusing of the aggregates; and optionally isolating the toner product, washing, and drying.

U.S. Pat. No. 5,945,245, the disclosure of which is totally incorporated herein by reference, illustrates a surfactant free process for the preparation of toner comprising heating a mixture of an emulsion latex, a colorant, and an organic complexing agent.

SUMMARY

It is a feature of the present invention to provide glossy toners by mixing a colorant dispersion with a latex emulsion, a wax dispersion, and a coagulant containing a metal ion, heating to provide toner size aggregates and stabilizing with a silicate salt thereby sequestering the metal ion.

Further features disclosed herein include the use of a sequestering or a complexing agent, such as a silicate salt, which permits the extraction of metal ions, such as aluminum, to provide a glossy toner; and a process wherein the silica metal complex forms a precipitate of a silica-metal ion complex thereby rendering the metal ion substantially insoluble and nonreactive, thus eliminating metal ion induced crosslinking; a toner process wherein the sequestering agent is dissolved in a base and which agent functions to extract or complex with coagulant metal ions and also acts to increase pH of the aggregates mixture when the aggregates are heated above the resin Tg to coalesce the particles with minimal increase in particle size or its distribution; a process wherein the sequestering or extraction of the metal complexing ion minimizes the ionomeric crosslinking within the polymer resin to provide in a toner with a glossy finish, and a toner process wherein an aqueous solution of a silicate salt dissolved in a base generates silica particles resulting from the silicate salt.

EMBODIMENTS

Further aspects of the present invention relate to a toner process comprised of a first heating of a colorant dispersion, a latex emulsion, and a wax dispersion in the presence of a coagulant containing a metal ion; adding a silicate salt; followed by a second heating; a process comprising heating a mixture of a colorant dispersion, a resin latex, and a coagulant, and wherein the heating involves a first heating and subsequently a second heating, and which second heating is at a higher temperature than the first heating, and wherein the second heating is above about the glass transition temperature of the latex resin, and which process is accomplished in the presence of a silicate salt; a process comprising heating a mixture of colorant and latex in the presence of a coagulant and a silicate salt, and wherein the heating comprises a first heating equal to or below about the glass transition temperature of a polymer contained in the latex, and a second heating equal to or above about the glass transition temperature of a polymer contained in the latex; wherein the first heating enables the formation of aggregates and the second heating enables the fusion of the colorant and the polymer; and optionally wherein the silicate is contained in an alkali metal hydroxide; a process wherein (i) the colorant dispersion contains colorant, water and an anionic surfactant, or a nonionic surfactant, and a wax dispersion is added comprised of submicron wax particles of from about 0.1 to about 0.5 micron in diameter by volume, and which wax is dispersed in water and an anionic surfactant to provide a mixture containing colorant and a wax;

(ii) blending a latex emulsion comprised of submicron resin particles of about 150 to about 300 nanometers in diameter and containing water, an anionic surfactant or a nonionic surfactant;

(iii) wherein the resulting blend possesses a pH of about 2.2 to about 2.8 to which is added a coagulant, such as a polymetal halide, to initiate flocculation or aggregation of the blend components;

(iv) heating the resulting mixture of (iii) below about the glass transition temperature (Tg) of the latex resin to form toner sized aggregates;

(v) adding to the formed toner aggregates a second potion latex (ii) comprised of resin suspended in an aqueous phase containing an ionic of surfactant and water, and stirring for a period of time to permit stabilization of the aggregate particle size;

(vi) adding to the resulting mixture of (v) an aqueous solution of a silicate salt dissolved in a base and followed by the addition of further base to thereby change the pH, which is initially from about 2 to about 2.8, to arrive at a pH of from about 7 to about 7.5;

(vii) heating the resulting aggregate mixture of (vi) above about the Tg of the latex containing resin of (i);

(viii) retaining the mixture temperature at from about 85° C. to about 95° C. for an optional period of about 10 to about 60 minutes, followed by a pH reduction with an acid to arrive at a pH of about 3.8 to about 6;

(ix) retaining the mixture temperature at from about 85° C. to about 95° C. for a period of about 4 to about 6 hours to assist in permitting the fusion or coalescence of the toner aggregates and to obtain smooth particles;

(x) washing the resulting toner slurry; and (xi) isolating, and drying the toner; a toner process wherein the toner obtained when analyzed for aluminum and silica indicates that about 5 to about 50 percent of aluminum is extracted depending on the amount of sodium silicate used as a sequestering agent, for example, when the sequestering agent amount is about 0.5 to about 1.5 the amount of the metal ion sequestering, such as aluminum, is about 50 to about 95 percent by weight of toner; a process wherein the colorant dispersion comprises particles dispersed in water and an anionic surfactant, and which dispersion possesses a pH of about 6.3 to about 6.8; a process wherein the wax dispersion comprises particles dispersed in water and an ionic surfactant; a process wherein the toner possesses a minimum fix temperature (MFT) of about 160° C. to about 200° C.; a process wherein the toner hot offset temperature (HOT) is in excess of about 200° C.; a process wherein the colorant dispersion is present in an amount of about 4 to about 8 percent by weight of toner; a process wherein the latex resin particles are from about 0.15 to about 0.3 micron in volume average diameter; a process wherein the colorant is of a size of about 0.01 to about 0.2 micron in average volume diameter; a process wherein the acid is selected from the group consisting of nitric, sulfuric, hydrochloric, citric, acetic acid, and the like; a process wherein the silicate is selected from the group comprised of sodium silicate, potassium silicate, or magnesium sulfate silicate; a process wherein the silicate salt dissolved in the base is added to the toner size aggregates and which salt sequesters or extracts out the aluminum ions and eliminates aluminum induced crosslinking of the polymeric resin to provide a glossy toner; a process wherein the addition of a basic silicate salt provides a means to stabilize the toner size aggregates from further growth during coalescence when the temperature of the aggregate mixture is raised above the resin Tg; a process wherein there is added to the formed toner size aggregates a third latex comprised of submicron resin particles suspended in an aqueous phase containing an anionic surfactant, and wherein the second portion of the latex is selected in an amount of from about 10 to about 40 percent by weight of the initial latex to form, a shell on the formed aggregates, and which shell is of a thickness of, for example, about 0.2 to about 0.8 micron; a process wherein the added latex contains the same resin as the initial latex of (i), or wherein the added latex contains a dissimilar resin than that of the initial latex; a process wherein the pH of the mixture resulting in (vi) is increased from about 2 to about 2.6 to about 7 to about 7.4 by the addition of a sodium silicate dissolved in sodium hydroxide which functions as a stabilizer for the aggregates when the temperature of the coalescence (vi) is raised above the resin Tg; a process wherein the temperature at which toner sized aggregates are formed controls the size of the aggregates, and wherein the final toner size is from about 5 to about 12 microns in volume average diameter; a process wherein the aggregation (iv) temperature is from about 45° C. to about 65° C., and wherein the coalescence or fusion temperature of, for example, (vii) and (viii) is from about 85° C. to about 95° C.; a process wherein the time of coalescence or fusion is from about 5 to about 10 hours, and wherein there are provided toner particles with a smooth morphology; a process wherein the latex contains a resin or polymer selected from the group consisting of poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly (styrene-alkyl acrylate-acrylonitrile-acrylic acid), poly (styrene-1,3-diene-acrylonitrile-acrylic acid), and poly(alkyl acrylate-acrylonitrile-acrylic acid); a process wherein the latex contains a resin selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly (styrene-butyl acrylate-acrylononitrile-acrylic acid); a process for the preparation of a toner comprising mixing (i) a colorant dispersion containing colorant, water and an anionic surfactant with a wax dispersion comprised of submicron wax particles of from about 0.1 to about 0.6 micron in diameter by volume, and which wax is dispersed in an anionic surfactant to provide a mixture containing, colorant and a wax dispersion;

(ii) wherein the mixture of (i) is blended with a first portion of a latex emulsion comprised of submicron resin particles of about 200 to about 300 nanometers and containing water, and an anionic surfactant or a nonionic surfactant;

(iii) wherein the resulting blend which possesses a pH of about 2.2 to about 2.8 is added a cationic coagulant of polyaluminum chloride to initiate flocculation or aggregation of the components of (i) and (ii);

(iv) heating the resulting mixture of (iii) below about the glass transition temperature (Tg) of the latex resin to form aggregates;

(v) adding to the formed aggregates a second portion of the latex (ii), and stirring for a period of time to permit stabilization of the aggregate particle size;

(vi) adding to the resulting mixture of (v) an aqueous solution of sodium silicate dissolved in sodium hydroxide, followed by the addition of additional base to thereby change the pH, which is initially from about 2 to about 2.9, to arrive at a pH of from about 7 to about 7.5 and allowing the mixture to stir for a period of about 5 to about 10 minutes;

(vii) heating the resulting aggregate suspension of (vi) above about the Tg of the latex resin of (i);

(viii) retaining the resulting mixture temperature at from about 85° C. to about 95° C. for an optional period of about 10 to about 75 minutes, followed by a pH reduction with an acid to arrive at a pH of about 4 to about 6;

(ix) retaining the resulting mixture temperature at from about 85° C. to about 95° C. for a period of about 4 to about 10 hours to assist in permitting the fusion or coalescence of the toner aggregates and to obtain smooth particles;

(x) washing the resulting toner slurry; and (xi) isolating and drying the toner particle;

(i) a toner process wherein there is selected a first portion latex, a colorant dispersion which contains water and an anionic surfactant, and a wax dispersion comprised of submicron wax particles of from about 0.1 to about 0.5 micron in diameter by volume, and which wax is dispersed in an anionic surfactant;

(ii) wherein the latex is comprised of resin particles, water and an anionic surfactant;

(iii) adding to the resulting mixture with a pH of about 2 to about 2.9 a coagulant, and which coagulant is a polymetal halide, a cationic surfactant, or mixtures thereof to primarily enable flocculation of the resin latex, the colorant, and the wax;

(iv) heating the resulting mixture below the glass transition temperature (Tg) of the latex resin to form aggregates;

(v) adding to the formed aggregates a second portion of the latex comprised of resin suspended in an aqueous phase containing an ionic surfactant and water;

(vi) adding to the resulting mixture of (v) an aqueous solution of sodium silicate dissolved in sodium hydroxide, followed by the addition of a base to thereby change the pH from an initial about 2 to about 2.9 to a pH of from about 7 to about 8;

(vii) heating the resulting aggregate suspension of (vi) to above the Tg of the latex resin of (i);

(viii) optionally retaining the mixture temperature at from about 70° C. to about 95° C. optionally for a period of about 10 to about 80 minutes, followed by a pH reduction with an acid to arrive at a pH of about 4 to about 6 to assist in permitting the fusion or coalescence of the toner aggregates;

(ix) further retaining the mixture temperature at from about 85° C. to about 95° C. for an optional period of about 4 to about 10 hours to assist in permitting the fusion or coalescence of the toner aggregates and to obtain smooth particles; and (x) washing the resulting toner slurry; and isolating the toner; a process wherein the colorant dispersion contains a colorant, water, and nonionic surfactant, wherein the colorant is present in an amount of from about 4 to about 10 weight percent; a process wherein the coagulant is comprised of a first coagulant of a polymetal halide present in an amount of about 0.02 to about 2 percent by weight of toner, and a further second cationic surfactant coagulant present in an amount of about 0.1 to about 5 percent by weight of toner; a process wherein the toner possesses a minimum fix temperature (MFT) of about 170° C. to about 200° C.; a process wherein the toner hot offset temperature (HOT) is from about 195° C. to about 210° C.; a process wherein the colorant amount is from about 3 to about 10 percent by weight of toner; a process wherein the acid is nitric, sulfuric, hydrochloric, citric or acetic acid, and the coagulant is comprised of a first coagulant of a polyaluminum chloride, and optionally a second coagulant of a cationic surfactant; a process wherein the base is introduced in the form of a silicate salt dissolved in a base selected from the group consisting of sodium hydroxide and potassium hydroxide, and wherein the second latex is selected in an amount of from about 10 to about 40 percent by weight of the initial latex (i) to form a shell thereover on the formed aggregates, and which shell is of an optional thickness of about 0.2 to about 0.8 micron, and wherein the coagulant is a polymetal halide; a process wherein the aggregation (iv) temperature is from about 45° C. to about 65° C., and wherein the coalescence or fusion temperature of (vii) and (viii) is from about 75° C. to about 95° C.; a process wherein the coagulant is a polymetal halide of polyaluminum chloride, a polyaluminum sulfosilicate, or a polyaluminum sulfate, and optionally a second cationic surfactant coagulant of an alkylbenzyl dimethyl ammonium chloride; a process wherein the wax dispersion contains a polyethylene wax, water, and an anionic surfactant, and wherein the wax is selected in an amount of from about 5 to about 20 weight percent; a process wherein the wax dispersion contains a polypropylene wax, water, and an anionic surfactant, and wherein the wax is selected in an amount of from about 5 to about 20 weight percent; a process wherein the optional second coagulant is selected from the group comprised of alkylbenzyl dimethyl ammonium chloride, dialkyl benzenealkyl ammonium chloride, lauryl trimethyl ammonium chloride, alkylbenzyl methyl ammonium chloride, alkylbenzyl dimethyl ammonium bromide, benzalkonium chloride, cetyl pyridinium bromide, and the like present in an amount of about 0.1 to about 5 percent by weight of toner; a process wherein the resin is selected in an amount of from about 40 to about 65 weight percent, the wax is selected in an amount of from about 5 to about 15 weight percent, and wherein the total thereof of the components is about 100 percent based on the toner; a process wherein the resulting toner possesses a shape factor of from about 110 to about 148; a process wherein the latex resin or polymer has a glass transition temperature (Tg) of about 45° C. to about 70° C.; a process wherein the resin possesses a weight average molecular weight of about 20,000 to about 90,000; a process wherein the latex polymer can contain a carboxylic acid, and which carboxylic acid is, for example, selected from the group comprised of acrylic acid, methacrylic acid, itaconic acid, beta carboxy ethyl acrylate, and the like, and wherein the carboxylic acid is present in an amount of from about 0.1 to about 7 weight percent; a process comprising the heating of a colorant dispersion, a latex emulsion, and coagulants, wherein one of the coagulants is a polyaluminum chloride, or bromide, and the optional second coagulant of a cationic surfactant, such as an alkylbenzyl dimethyl ammonium chloride, and wherein the mixture is aggregated by heating below the latex resin glass transition temperature, followed by the addition of silicate salt dissolved in a base, and thereafter, heating above the latex resin glass transition temperature; a toner process as illustrated herein wherein the amount of latex resin is from about 40 to about 65 weight percent, the colorant amount is from about 4 to about 10 weight percent, and the wax amount is from about 5 to about 15 weight percent, and the total of the components is 100 percent; a process for preparing a chemical toner wherein the blending and aggregation are performed at a pH of about 2 to about 3 or about 2 to about 2.8, while the coalescence is initially conducted at a pH of about 7 to about 8 followed by a reduction in pH to about 4 to about 6, and followed by further heating for a period of hours, for example about 4 to about 6 hours; and a process for preparing a toner composition by emulsion aggregation, which toner possesses a smooth shape and feel, and wherein the toner colorant possesses a size distribution of about 1.20 to about 1.26; a toner process with a multi-stage addition of latex, for example a second portion of about 20 to about 40 percent of the total amount of latex, is retained while the remainder, a first portion, is subjected to homogenization and aggregation, thus a majority of the latex can be added at the onset while the remainder of the latex (the delayed latex) is added after the formation of the resin aggregates; a toner process resulting in toner particles of, for example, an average volume diameter of from about 0.5 to about 25, and more specifically, from about 1 to about 10 microns, and narrow GSD characteristics of, for example, from about 1.05 to about 1.25, or from about 1.15 to about 1.25 as measured by a Coulter Counter, and an excellent shape factor, for example, of 135 or less wherein the shape factor refers, for example, to the measure of toner smoothness and toner roundness, where a shape factor of about 100 is considered spherical and smooth without any surface protrusions, while a shape factor of about 150 is considered to be rough in surface morphology and the shape is like a potato.

The resin particles selected for the process of the present invention can be prepared by, for example, known emulsion polymerization methods, including semicontinuous emulsion polymerization methods, and the monomers utilized in such processes can be selected from, for example, styrene, acrylates, methacrylates, butadiene, isoprene, acrylonitrile; monomers comprised of an A and a B monomer wherein from about 72 to about 95 percent of A and from about 5 to about 28 percent of B is selected, wherein A can be, for example, styrene, and B can be, for example, an acrylate, methacrylate, butadiene, isoprene, or an acrylonitrile; and optionally, acid or basic olefinic monomers, such as acrylic acid, methacrylic acid, beta carboxy ethyl acrylate, acrylamide, methacrylamide, quaternary ammonium halide of dialkyl or trialkyl acrylamides or methacrylamide, vinylpyridine, vinylpyrrolidone, vinyl-N-methylpyridinium chloride and the like. The presence of acid or basic groups in the monomer or polymer resin is optional, and such groups can be present in various amounts of from about 0.1 to about 10 percent by weight of the polymer resin. Chain transfer agents, such as dodecanethiol or carbon tetrabromide, can also be selected when preparing resin particles by emulsion polymerization. Other processes of obtaining resin particles of, for example, from about 0.01 micron to about 2 microns in diameter can be selected from polymer microsuspension process, such as those illustrated in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding process, or other known processes.

Various known colorants, such as pigments, selected for the processes of the present invention and present in the toner in an effective amount of, for example, from about 1 to about 25 percent by weight of toner, and more specifically, in an amount of from about 3 to about 10 percent by weight include, for example, carbon black like REGAL 330®; REGAL 660®; phthalocyanine Pigment Blue 15, Pigment Blue 15.1, Pigment Blue 15.3, Pigment Green 7, Pigment Green 36, Pigment Orange 5, Pigment Orange 13, Pigment Orange 16, Pigment Orange 36, Pigment Red 122, Pigment Red 53.1, Pigment Red 48.1, Pigment Red 48.2, Pigment Red 49.1, Pigment Red 49.2, Pigment Red 22, Pigment Red 185, Pigment Red 188, Pigment Red 210, Pigment Red 238, Pigment Red 170, Pigment Red 23, Pigment Red 81.2, Pigment Red 81.3, Pigment Red 57, Pigment Red 17, Pigment Red 169, Pigment Violet 19, Pigment Violet 23, Pigment Violet 3, Pigment Violet 27, Pigment Yellow 65, Pigment Yellow 1, Pigment Yellow 83, Pigment Yellow 17, Pigment Yellow 12, Pigment Yellow 14, Pigment Yellow 97, Pigment Yellow 74, Pigment Yellow 3, Pigment Yellow 75, available from Sun Chemicals, PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ available from Hoechst, and CINQUASIA MAGENTA™ available from E. I. DuPont de Nemours and Company, and the like. Generally, colored pigments that can be selected are cyan, magenta, or yellow pigments, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans that may be selected include copper tetra(octadecyl sulfonamido) phthalocyanine, x-copper phthalocyanine pigment identified in the Color Index as Cl 74160, CI Pigment Blue, and Anthrathrene Blue, identified in the Color Index as Cl 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Yellow 180 and Permanent Yellow FGL, wherein the colorant is present, for example, in the amount of about 3 to about 15 weight percent of the toner. Organic dye examples include known suitable dyes, reference the Color Index, and a number of U.S. patents. Organic soluble dye examples, preferably of a high purity, for the purpose of color gamut are Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20 percent by weight, and more specifically, from about 5 to about 20 weight percent Of the toner. Colorants include pigment, dye, mixtures of pigment and dyes, mixtures of pigments, mixtures of dyes, and the like.

Examples of anionic surfactants include, for example, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN RK™, NEOGEN SC™ from Kao, and the like. An effective concentration of the anionic surfactant generally employed is, for example, from about 0.01 to about 10 percent by weight, and preferably from about 0.1 to about 5 percent by weight of monomers used to prepare the toner polymer resin.

Examples of nonionic surfactants that may be, for example, included in the resin latex dispersion include, for example, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhodia as IGEPAL CA-210®, IGEPAL CA-520®, IGEPAL CA-720®, IGEPAL CO-890®, IGEPAL CO-720®, IGEPAL CO-290®, IGEPAL CA-210®, ANTAROX 890® and ANTAROX 897®. A suitable concentration of the nonionic surfactant is, for example, from about 0.01 to about 10 percent by weight, and preferably from about 0.1 to about 5 percent by weight of monomers used to prepare the toner polymer resin.

Examples of cationic surfactants, which are usually positively charged, selected for the toners and processes of the present invention include, for example, alkylbenzyl dimethyl ammonium chloride, dialkyl benzenealkyl ammonium chloride, lauryl trimethyl ammonium chloride, alkylbenzyl methyl ammonium chloride, alkylbenzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof. A suitable amount of the surfactant can be selected, such as from about 0.2 to about 5 percent by weight of the toner components.

Examples of silicate that can be selected are sodium silicates, such as those commercially available like A®1647, A®1847, A®2445, A®2447, A®2645, BJ™ 120, BW™ 50, C™, D™, E™, K®, M®, N®, N®38, N® Clear, O®, OW®, RU™, SS® 22, SS® 75, STAR™, STARSO®, STIXSI™ RR, V®. Potassium silicates such as KASIL® 1, KASIL® 6, KASIL® 23, all available from Philadelphia Quartz; sodium silicate Cat. #33,844-3 available from Aldrich Chemicals; OXYCHEM GRADE 40, GRADE 42, GRADE JW-25, GRADE 47, GRADE 49F, GRADE 50, GRADE 52, GRADE WD-43 all available from Occidental Chemical Corporation; KS NO1, NO2, NO3, NO4, SC2, SP2, SB3, G3, SS3 all available from ESEL TechTra Inc., South Korea; sodium silicates available from J. T. Baker, and the like. The silicates in embodiments exhibit a mole ratio of $SiO_2$:$Na_2O$ of about 1.5 to about 3.5, and a mole ratio of $SiO_2$:$Na_2O$ about 1.8 to about 2.5; a particle size of about 5 to 80 nanometers, a viscosity at 20° C. and as measured by a Brookfield viscometer of about 20 to about 1,200 centipoises and a density of about 1.25 to about 1.70 gram per $cm^3$.

The coagulant is in embodiments present in an aqueous medium in an amount of from, for example, about 0.05 to about 10 percent by weight, and more specifically, in an amount of from about 0.075 to about 2 percent by weight. The coagulant may also contain minor amounts of other components, for example nitric acid. The coagulant is usually added slowly into the blend while continuously subjecting the blend to high shear, for example, by stirring with a blade at about 3,000 to about 10,000 rpm, and more specifically about 5,000 rpm, for about 1 to about 120 minutes. A high shearing device, for example an intense homogenization device, such as the in-line IKA SD-41, may be used to ensure that the blend is homogeneous and uniformly dispersed.

Counterionic coagulants may be comprised of organic, or inorganic entities, and the like. For example, in embodiments the ionic surfactant of the resin latex dispersion can be an anionic surfactant, and the counterionic coagulant can be a polymetal halide or a polymetal sulfo silicate (PASS). Coagulants that can be included in amounts of, for example, from about 0.05 to about 10 weight percent are polymetal halides, polymetal sulfosilicates monovalent, divalent or multivalent salts optionally in combination with cationic surfactants, and the like. Inorganic cationic coagulants include, for example, polyaluminum chloride (PAC), polyaluminum sulfo silicate (PASS), aluminum sulfate, zinc sulfate, or magnesium sulfate.

Examples of waxes include those as illustrated herein, such as those of the aforementioned copending applications, polypropylenes and polyethylenes commercially available from Allied Chemical and Petrolite Corporation, wax emulsions available from Michaelman Inc. and the Daniels Products Company, EPOLENE N-15™ commercially available from Eastman Chemical Products, Inc., VISCOL 550-P™, a low weight average molecular weight polypropylene available from Sanyo Kasei K.K., and similar materials. The commercially available polyethylenes selected possess, it is believed, a molecular weight $M_w$ of from about 1,000 to about 3,000, while the commercially available polypropylenes utilized for the toner compositions of the present invention are believed to have a molecular weight of from about 4,000 to about 7,000. Examples of functionalized waxes include amines, amides, for example AQUA SUPERSLIP 6550™, SUPERSLIP 6530™ available from Micro Powder Inc., fluorinated waxes, for example POLYFLUO 190™, POLYFLUO 200™, POLYFLUO 523XF™, AQUA POLYFLUO 411™, AQUA POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, chlorinated polypropylenes and polyethylenes available from Allied Chemical and Petrolite Corporation and SC Johnson Wax.

The solids content of the resin latex dispersion is not particularly limited, thus the solids content may be from, for example, about 10 to about 90 percent. With regard to the colorants, in some instances they are available in the wet cake or concentrated form containing water, and can be easily dispersed utilizing a homogenizer or simply by stirring or ball milling, attrition, or media milling. In other instances, pigments are available only in a dry form whereby dispersion in water is effected by microfluidizing using, for example, a M-110 microfluidizer or an ultimizer, and passing the pigment dispersion from about 1 to about 10 times through a chamber by sonication, such as using a Branson 700 sonicator, with a homogenizer, ball milling, attrition, or media milling with the optional addition of dispersing agents such as the aforementioned ionic or nonionic surfactants.

During the coalescence, the pH is increased, for example, from about 2 to about 3 to about 7 to about 8, by the addition of a suitable pH increasing agent of, for example, sodium silicate dissolved in sodium hydroxide to provide for stabilization of aggregate particles and to prevent/minimize toners size growth and loss of GSD during further heating, for example, raising the temperature about 10° C. to about 50° C. above the resin Tg; and also the silicate acts as a sequestering agent substantially avoiding aluminum ionomeric crosslinking of the resin. Examples of pH reducing agents include, for example, nitric acid, citric acid, sulfuric acid or hydrochloric acid, and the like.

The toner particles illustrated herein may also include known charge additives in effective amounts of, for example from about 0.1 to about 5 weight percent such as alkyl pyridinium halides, bisulfates, the charge control additives of U.S. Pat. Nos. 3,944,493; 4,007,293; 4,079,014; 4,394,430 and 4,560,635, the disclosures of which are totally incorporated herein by reference, and the like. Surface additives that can be added to the toner compositions after washing or drying include, for example, metal salts, metal salts of fatty acids, colloidal silicas, metal oxides, mixtures thereof, and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Specific additives include zinc stearate and AEROSIL R972® available from Degussa Chemical and present in an amount of from about 0.1 to about 2 percent which can be added during the aggregation process or blended into the formed toner product.

Developer compositions can be prepared by mixing the toners obtained with the process of the present invention with known carrier particles, including coated carriers, such as steel, ferrites, and the like, reference U.S. Pat. Nos. 4,937,166 and 4,935,326, the disclosures of which are totally incorporated, herein by reference, for example from about 2 percent toner concentration to about 8 percent toner concentration.

The following Examples are provided. Parts and percentages are by weight unless otherwise indicated and temperatures are in degrees Centigrade.

EXAMPLES

Preparation of Latex A:

A latex emulsion (i) comprised of polymer particles generated from the emulsion polymerization of styrene, butyl acrylate and beta carboxy ethyl acrylate (Beta CEA) was prepared as follows. A surfactant solution of 434 grams of DOWFAX 2A1™ (anionic emulsifier −55 percent active ingredients) and 387 kilograms of deionized water was prepared by mixing these components for 10 minutes in a stainless steel holding tank. The holding tank was then purged with nitrogen for 5 minutes before transferring the mixture into a reactor. The reactor was then continuously purged with nitrogen while being stirred at 100 RPM. The reactor was then heated to 80° C.

Separately, 6.11 kilograms of ammonium persulfate initiator were dissolved in 30.2 kilograms of deionized water. Also, separately a monomer emulsion A was prepared in the following manner. 315.7 Kilograms of styrene, 91.66 kilograms of butyl acrylate, 12.21 kilograms of beta-CEA, 7.3 kilograms of 1-dodecanethiol, 1.42 kilograms of decanediol diacrylate (ADOD), 8.24 kilograms of DOWFAX™ (anionic surfactant), and 193 kilograms of deionized water were mixed to form an emulsion. Five percent of the above emulsion was then slowly fed into the reactor containing the above aqueous surfactant phase at 80° C. to form seeds wherein "seeds" refer, for example, to the initial emulsion latex added to the reactor prior to the addition of the initiator solution, while being purged with nitrogen. The above initiator solution was then slowly charged into the reactor forming about 5 to about 12 nanometers of latex "seed" particles. After 10 minutes, the remainder of the emulsion was continuously fed in using metering pumps.

After the above monomer emulsion was charged into the main reactor, the temperature was maintained at 80° C. for an additional 2 hours to complete the reaction. The reactor contents were then cooled down to about 25° C. The resulting isolated product was comprised of 40 weight percent of about 0.2 micron diameter resin particles of styrene/butylacrylate/beta CEA suspended in an aqueous phase containing the above surfactant. The molecular properties resulting for the resin latex were $M_w$ (weight average molecular weight) of 35,000, $M_n$ of 10.6, as measured by a Gel Permeation Chromatograph, and a midpoint Tg of 55.8° C., as measured by a Differential Scanning Calorimeter, where the midpoint Tg is the halfway point between the onset and the offset Tg of the polymer.

Wax and Pigment Dispersions:

The aqueous wax dispersion utilized in the following Examples was generated using waxes available from Baker-Petrolite; (1) P725 polyethylene wax with a low molecular weight $M_w$ of 725, and a melting point of 104° C., or (2) P850 wax with a low molecular weight of 850 and a melting point of 107° C. and NEOGEN RK™ as an anionic surfactant/dispersant. The wax particle diameter size was determined to be approximately 200 nanometers, and the wax slurry was a solid loading of 30 percent (weight percent throughout).

The pigment dispersion, obtained from Sun Chemicals, was an aqueous dispersion containing 19 percent carbon black (REGAL 330®), an anionic surfactant, 2 percent, and 79 percent water.

Preparation of Sodium Silicate Solution (Solution A):

The sodium silicate solution contained about 27 percent sodium silicate solids dissolved in sodium hydroxide solution.

Example I

5 Percent Cyan, 9 Percent PW725 Wax—PAC (0.18 pph/2 pph of Silica ($SiO_2$):

204 Grams of latex A having a solids loading of 40 weight percent and 45.7 grams of wax emulsion (POLYWAX 725®) having a solids loading of 30 weight percent were added to 455 grams of deionized water in a vessel and stirred using an IKA ULTRA TURRAX® T50 homogenizer operating at 4,000 rpm. Thereafter, there were added 48.1 grams of a cyan pigment dispersion PB15:3 having a solids loading of 17 weight percent, followed by the addition of 27 grams of a flocculent mixture containing 2.7 grams polyaluminum chloride mixture and 24.3 grams 0.02 molar nitric acid solution. Thereafter, the mixture was heated at 1° C. per minute to a temperature of 49° C. and held there for a period of about 1.5 to about 2 hours resulting in a volume average particle diameter of 5 microns as measured with a Coulter Counter. During the heat up period, the stirrer was operated at about 250 rpm and 10 minutes after the set temperature of 49° C. was reached, the stirrer speed was reduced to about 220 rpm. An additional 103.9 grams of latex A were added to the reactor mixture and the mixture was allowed to aggregate for an additional period of about 30 minutes at 49° C. resulting in a volume average particle diameter of about 5.7 microns. At this time, 11.11 grams of sodium silicate solution A were added to the reactor mixture. As a result, the pH was increased from about 2.5 to about 4.5, and wherein the sodium silicate acted as an aluminum-sequestering agent. A basic solution of 4 percent NaOH in distilled water was then added to the toner mixture obtained to increase the pH to 7, which freezes the particle size. Thereafter, the reactor mixture was heated at 1° C. per minute to a temperature of 95° C., followed by adjusting the reactor mixture pH to 6 with 0.3 M nitric acid solution. Following this, the reactor mixture was gently stirred at 95° C. for 5 hours to enable the particles to coalesce and spheroidize. The reactor heater was then turned off and the reactor mixture was allowed to cool to room temperature at rate of 1° C. per minute. The resulting mixture was comprised of about 16.7 percent toner solids, 0.25 percent of anionic surfactant and about 82.9 percent by weight of water. The toner of this mixture comprised 86 percent of styrene/acrylate polymer, 5 percent of PB15:3 cyan pigment, 9 percent by weight of PW725 wax, and had a volume average particle diameter of about 5.8 microns and a GSD of about 1.18. The particles were washed 6 times, where the first wash was conducted at pH of 10 at 63° C., followed by 3 washes with deionized water at room temperature, one wash carried out at a pH of 4 at 40° C., and a final wash with deionized water at room temperature. The toner morphology was shown to be spherical in shape as determined by scanning electron microscopy. Aluminum analysis of the toner by ICP indicated an aluminum content of 51 ppm out of a starting amount of 952 ppm evidencing that very little of aluminum was retained in the toner. The dry toner was fused on a free-belt nip fuser of the type currently used in the Xerox Corporation DocuColor 2240. The gloss attained was 74.1 GGU at a temperature of 1.60° C., as measured using a Gardner Gloss Meter using a 75° angle. The Minimum Fixing Temperature (MFT) was 125° C.

Example II

5 Percent Cyan, 12 Percent PW725 Wax—PAC (0.18 pph/2 pph of Silica ($SiO_2$):

204 Grams of latex A having a solids loading of 40 weight percent and 60.9 grams of wax emulsion (POLYWAX 725®) having a solids loading of 30 weight percent were added to 455 grams of deionized water in a vessel and stirred using an IKA ULTRA TURRAX® T50 homogenizer operating at 4,000 rpm. Thereafter, there were added 48.1 grams of a cyan pigment dispersion PB15:3 having a solids loading of 17 weight percent, followed by the addition of 27 grams of a flocculent mixture containing 2.7 grams of polyaluminum chloride, and 24.3 grams of 0.02 molar nitric acid solution. Thereafter, the mixture was heated at 1° C. per minute to a temperature of 49° C. and held there for a period of about 1.5 to about 2 hours resulting in a volume average particle diameter of 5 microns as measured with a Coulter Counter. During heat up period, the stirrer was operated at about 250 rpm and 10 minutes after the set temperature of 49° C. was reached, the stirrer speed was reduced to about 220 rpm. An additional 103.9 grams of latex A were added to the reactor mixture and allowed to aggregate for an additional period of about 30 minutes at 49° C. resulting in a volume average particle diameter of about 5.7 microns. At this time, 11.11 grams of sodium silicate solution A were added to the reactor mixture. As a result, the pH was increased to 4, and the sodium silicate acted as an aluminum-sequestering agent. A basic solution of 4 percent NaOH in distilled water was then added to the toner mixture to increase the pH to 7. Thereafter, the reactor mixture was heated at 1° C. per minute to a temperature of 95° C., followed by adjusting the reactor mixture pH to 6 with a 0.3 M nitric acid solution. Following this, the reactor mixture was gently stirred at 95° C. for 5 hours to enable the particles to coalesce and spheroidize. The reactor heater was then turned off and the reactor mixture was allowed to cool to room temperature (22° C. to 25° C.) at a rate of 1° C. per minute. The toner of this mixture was comprised of 83 percent of styrene/acrylate polymer, 5 percent of PB15:3 cyan pigment, and 12 percent by weight of PW725 wax, and had a volume average particle diameter of about 6.3 microns and a GSD of about 1.23. The particles were washed 6 times, where the first wash was conducted at a pH of 10 at 63° C., followed by 3 washes with deionized water at room temperature, one wash at a pH of 4 at 40° C., and a final wash with deionized water at room temperature. The toner morphology was shown to be spherical in shape as determined by scanning electron microscopy. Aluminum analysis of the toner by ICP indicated an aluminum content of 24 ppm out of a starting amount of 952 ppm indicating that very little aluminum was retained in the final toner particles. The dry toner was fused on a free-belt nip fuser of the type used in the Xerox Corporation DocuColor 2240. The gloss attained was 68.1 GGU at a temperature of 160° C., as measured using a Gardner Gloss Meter at a 75° angle. The toner Minimum Fixing Temperature (MFT) was 123° C.

Example III

5 Percent Cyan, 9 Percent PW725 Wax—PAC (0.18 pph/1 pph of Silica ($SiO_2$):

204 Grams of latex A having a solids loading of 40 weight percent and 45.7 grams of wax emulsion (POLYWAX 725®) having a solids loading of 30 weight percent were added to 455 grams of deionized water in a vessel and stirred using an IKA Ultra TURRAX® T50 homogenizer operating at 4,000 rpm. Thereafter, there were added 48.1 grams of cyan pigment dispersion PB15:3 having a solids loading of 17 weight percent, followed by the addition of 27 grams of a flocculent mixture containing 2.7 grams of polyaluminum chloride mixture and 24.3 grams of 0.02 molar nitric acid solution. Thereafter, the mixture was heated at 1° C. per minute to a temperature of 49° C. and held there for a period of about 1.5 to about 2 hours resulting in a volume average particle diameter of 5 microns as measured with a Coulter Counter. During the heat up period, the stirrer was engaged at about 250 rpm and 10 minutes after the set temperature of 49° C. was reached, the stirrer speed was reduced to about 220 rpm. An additional 103.9 grams of latex A were added to the reactor mixture and allowed to aggregate for an additional period of about 30 minutes at 49° C. resulting in a volume average particle diameter of about 5.7 microns. At this time, 5.56 grams of sodium silicate solution A were added to the reactor mixture. As a result, the pH was increased to 4, and the sodium silicate acted as an aluminum-sequestering agent. A basic solution of 4 percent NaOH in distilled water was then added to the toner mixture to increase the pH to 7. Thereafter, the reactor mixture was heated at 1° C. per minute to a temperature of 95° C., followed by adjusting the reactor mixture pH to 6 with 0.3 M nitric acid solution. Following this, the reactor mixture was gently stirred at 95° C. for 5 hours to enable the particles to coalesce and spheroidize. The reactor heater was then turned off and the reactor mixture was allowed to cool to room temperature at rate of 1° C. per minute. The toner of this mixture comprised 86 percent of styrene/acrylate polymer, 5 percent of PB15:3 cyan pigment, 9 percent by weight of PW725 wax, and with a volume average particle diameter of about 5.8 microns and a GSD of about 1.19. The toner was washed in a similar manner as indicated in Example I. The toner morphology was shown to be spherical in shape as determined by scanning electron microscopy. Aluminum analysis of the toner by ICP indicated an aluminum content of 88 ppm out of a starting amount of 952 ppm indicating that very little of the aluminum was retained in the toner particles. The dry toner was fused on a free-belt nip fuser of the type used in the Xerox Corporation DocuColor 2240. The gloss attained was 73.2 GGU at a temperature of 160° C., as measured using a Gardner Gloss Meter at a 75° angle. The toner Minimum Fixing Temperature (MFT) was 126° C.

Example IV

5 Percent Cyan, 12 Percent PW725 Wax—PAC (0.18 pph/1 pph of Silica ($SiO_2$):

204 Grams of latex A having a solids loading of 40 weight percent and 60.9 grams of wax emulsion (POLYWAX 725®) having a solids loading of 30 weight percent are added to 455 grams of deionized water in a vessel and stirred using an IKA ULTRA TURRAX® T50 homogenizer operating at 4,000 rpm. Thereafter, there were added 48.1 grams of cyan pigment dispersion PB15:3 having a solids loading of 17 weight percent, followed by addition of 27 grams of a flocculent mixture containing 2.7 grams of polyaluminum chloride mixture and 24.3 grams of 0.02 molar nitric acid solution. Thereafter, the mixture was heated at 1° C. per minute to a temperature of 49° C. and held there for a period of about 1.5 to about 2 hours resulting in a volume average particle diameter of 5 microns as measured with a Coulter Counter. During the heat up period, the stirrer was engaged at about 250 rpm and 10 minutes after the set temperature of 49° C. was reached, the stirrer speed was reduced to about 220 rpm. An additional 103.9 grams of latex A were added to the reactor mixture, and allowed to aggregate for an additional period of about 30 minutes at 49° C. resulting in a volume average particle diameter of about 5.7 microns. At this time, 5.56 grams of sodium silicate solution A were added to the solution. As a result, the pH was increased to 4, and the sodium silicate acted as an aluminum-sequestering agent. A basic solution of 4 percent NaOH in distilled water was then added to the toner mixture to increase the pH to 7. Thereafter, the reactor mixture was heated at 1° C. per minute to a temperature of 95° C., followed by adjusting the reactor mixture pH to 6 with 0.3 M nitric acid solution. Following this, the reactor mixture was gently stirred at 95° C. for 5 hours to enable the particles to coalesce and spheroidize. The reactor heater was then turned off and the reactor mixture was allowed to cool to room temperature at a rate of 1° C. per minute. The toner of this mixture comprised 83 percent of styrene/acrylate polymer, 5 percent of PB15:3 cyan pigment, 12 percent by weight of PW725 wax, and with a volume average particle diameter of about 5.8 microns and a GSD of about 1.21. The toner was washed in a similar manner as indicated in Example I.

The toner morphology was shown to be spherical in shape as determined by scanning electron microscopy. Aluminum analysis of the toner by ICP indicated an aluminum content of 76 ppm out of a starting amount of 952 ppm indicating that very little of the aluminum was retained in the toner particles. The dry toner was then fused on a free-belt nip fuser of the type in the Xerox Corporation DocuColor 2240. The gloss attained was 66.5 GGU at a temperature of 160° C., as measured using a Gardner Gloss Meter at a 75° angle. The toner Minimum Fixing Temperature (MFT) was 124° C.

Example V

5 Percent Magenta, 12 Percent PW725 Wax—PAC (0.18 pph/1 pph of Silica ($SiO_2$):

196.6 Grams of latex A having a solids loading of 40 weight percent and 60.9 grams of wax emulsion (POLYWAX 725®) having a solids loading of 30 weight percent were added to 402.6 grams of deionized water in a vessel and stirred using an IKA ULTRA TURRAX® T50 homogenizer operating at 4,000 rpm. Thereafter, there were added 32.6 grams of magenta pigment dispersion PR 122 having a solids loading of 17.53 weight percent, and 50.64 grams of magenta pigment dispersion PR 238 having a solids loading of 11.3 weight percent, followed by addition of 27 grams of a flocculent mixture containing 2.7 grams of polyaluminum chloride mixture and 24.3 grams of 0.02 molar nitric acid solution. Thereafter, the mixture was heated at 1° C. per minute to a temperature of 49° C. and held there for a period of about 1.5 to about 2 hours resulting in a volume average particle diameter of 5 microns as measured with a Coulter Counter. During the heat up period, the stirrer was engaged at about 250 rpm and 10 minutes after the set temperature of 49° C. was reached, the stirrer speed was reduced to about 220 rpm. An additional 103.9 grams of latex A were added to the reactor mixture and allowed to aggregate for an additional period of about 30 minutes at 49° C. resulting in a volume average particle diameter of about 5.7 microns. At this time, 5.56 grams of sodium silicate solution A were added to the solution. As a result, the pH was increased to 4, and the sodium silicate acted as an aluminum-sequestering agent. A basic solution of 4 percent NaOH in distilled water was then added to the toner mixture to increase the pH to 7. Thereafter, the reactor mixture was heated at 1° C. per minute to a temperature of 95° C., followed by adjusting the reactor mixture pH to 6 with 0.3 M nitric acid solution. Following this, the reactor mixture was gently stirred at 95° C. for 5 hours to enable the particles to coalesce and spheroidize. The reactor heater was then turned off and the reactor mixture was allowed to cool to room temperature at a rate of 1° C. per minute. The toner of this mixture comprises 81 percent of styrene/acrylate polymer, 3.5 percent of PR 122 magenta pigment, 3.5 percent PR 238 magenta pigment, 12 percent by weight of PW725 wax, and with a volume average particle diameter of about 5.8 microns and a GSD of about 1.23. The toner was washed in a similar manner as indicated in Example I. The toner morphology was shown to be spherical in shape as determined by scanning electron microscopy. Aluminum analysis of the toner by ICP indicated an aluminum content of 272 ppm out of a starting amount of 952 ppm indicating that some of the aluminum was retained in the toner particles. The dry toner was fused on a free-belt nip fuser of the type in the Xerox Corporation DocuColor 2240. The gloss attained was 71.6 GGU at a temperature of 160° C., as measured using a Gardner Gloss Meter at a 75° angle. The toner Minimum Fixing Temperature (MFT) was 127° C.

Example VI

6 Percent Yellow, 12 Percent PW725 Wax—PAC (0.18 pph/1 pph of Silica ($SiO_2$):

00.3 Gram of latex A having a solids loading of 40 weight, percent and 60.9 grams of wax emulsion (POLYWAX 725®) having a solids loading of 30 weight percent, was added to 450 grams of deionized water in a vessel and stirred using an IKA ULTRA TURRAX® T50 homogenizer operating at 4,000 rpm. Thereafter, there were added 58.8 grams of yellow pigment dispersion PY 74 having a solids loading of 16.7 weight percent, followed by addition of 27 grams of a flocculent mixture containing 2.7 grams of polyaluminum chloride mixture and 24.3 grams of 0.02 molar nitric acid solution. Thereafter, the mixture was heated at 1° C. per minute to a temperature of 49° C. and held there for a period of about 1.5 to about 2 hours resulting in a volume average particle diameter of 5 microns as measured with a Coulter Counter. During the heat up period, the stirrer was engaged at about 250 rpm and 10 minutes after the set temperature of 49° C. was reached, the stirrer speed was reduced to about 220 rpm. An additional 103.9 grams of latex A were added to the reactor mixture and allowed to aggregate for an additional period of about 30 minutes at 49° C. resulting in a volume average particle diameter of about 5.7 microns. At this time, 5.56 grams of sodium silicate solution A were added to the solution. As a result, the pH was increased to 4, and the sodium silicate acted as an aluminum-sequestering agent. A basic solution of 4 percent NaOH in distilled water was then added to the toner mixture to increase the pH to 7. Thereafter, the reactor mixture was heated at 1° C. per minute to a temperature of 95° C., followed by adjusting the reactor mixture pH to 6 with 0.3 M nitric acid solution. Following this, the reactor mixture was gently stirred at 95° C. for 5 hours to enable the particles to coalesce and spheroidize. The reactor heater was then turned off and the reactor mixture was allowed to cool to room temperature at rate of 1° C. per minute. The toner of this mixture comprised 82 percent of styrene/acrylate polymer, 6 percent of PY 74 yellow pigment, 12 percent by weight of PW725 wax, and with a volume average particle diameter of about 5.8 microns and a GSD of about 1.23.

The toner was washed in a similar manner as indicated in Example I. The toner morphology was shown to be spherical in shape as determined by scanning electron microscopy. Aluminum analysis of the toner by ICP indicated an aluminum content of 359 ppm out of a starting amount of 952 ppm indicating that some of the aluminum was retained in the toner particles. The dry toner was fused on a free-belt nip fuser of the type currently used in the Xerox Corporation DocuColor 2240. The gloss attained was 67.9 GGU at a temperature of 160° C., as measured using a Gardner Gloss Meter at a 75° angle. The toner Minimum Fixing Temperature (MFT) was 127° C.

Example VII

6 Percent Black, 12 Percent PW725 wax—PAC (0.18 pph/1 pph of Silica ($SiO_2$):

200.3 Grams of latex A having a solids loading of 40 weight percent and 60.9 grams of wax emulsion (POLYWAX 725®) having a solids loading of 30.30 weight percent were added to 450 grams of deionized water in a vessel and stirred using an IKA ULTRA TURRAX® T50 homogenizer operating at 4,000 rpm. Thereafter, there were added 57 grams of black pigment dispersion REGAL 330® having a solids loading of 16.9 weight percent, followed by addition of 27 grams of a flocculent mixture containing 2.7 grams of polyaluminum chloride mixture and 24.3 grams of 0.02 molar nitric acid solution. Thereafter, the mixture was heated at 1° C. per minute to a temperature of 49° C. and held there for a period of about 1.5 to about 2 hours resulting in a volume average particle diameter of 5 microns as measured with a Coulter Counter. During the heat up period, the stirrer was engaged at about 250 rpm and 10 minutes after the set temperature of 49° C. was reached, the stirrer speed was reduced to about 220 rpm. An additional 103.9 grams of latex A were added to the reactor mixture and allowed to aggregate for an additional period of about 30 minutes at 49° C. resulting in a volume average particle diameter of about 5.7 microns. At this time, 5.56 grams of sodium silicate solution A were added to the solution. As a result, the pH was increased to 4, and the sodium silicate acted as an aluminum-sequestering agent. A basic solution of 4 percent NaOH in distilled water was then added to the toner mixture to increase the pH to 7. Thereafter, the reactor mixture was heated at 1° C. per minute to a temperature of 95° C., followed by adjusting the reactor mixture pH to 6 with 0.3 M nitric acid solution. Following this, the reactor mixture was gently stirred at 95° C. for 5 hours to enable the particles to coalesce and spheroidize. The reactor heater was then turned off and the reactor mixture was allowed to cool to room temperature at a rate of 1° C. per minute. The toner of this mixture comprised 82 percent of styrene/acrylate polymer, 6 percent of REGAL 330® black pigment, 12 percent by weight of PW725 wax, and with a volume average particle diameter of about 5.9 microns and a GSD of about 1.22. The toner was washed in a similar manner as indicated in Example I.

The toner morphology was shown to be spherical in shape as determined by scanning electron microscopy. Aluminum analysis of the toner by ICP indicated an aluminum content of 11 ppm out of a starting amount of 952 ppm indicating that very little of aluminum was retained in the toner particles. The dry toner was fused on a free-belt nip fuser of the type used in the Xerox Corporation DocuColor 2240. The gloss attained was 63.6 GGU at a temperature of 160° C., as measured using a Gardner Gloss Meter at a 75° angle. The toner Minimum Fixing Temperature (MFT) was 131° C.

Comparative Example 1

5 Percent Cyan, 9 Percent PW725 Wax, 5 Percent Colloidal Silica—PAC (0.18 pph)

262.1 Grams of latex A having a solids loading of 40 weight percent and 60.89 grams of wax emulsion (POLYWAX 725®) having a solids loading of 300 weight percent, were added to 588 grams of deionized water in a vessel and stirred using an IKA Ultra TURRAX® T50 homogenizer operating at 4,000 rpm. Thereafter, there were added 64.1 grams of cyan pigment dispersion PB15:3 having a solids loading of 17 weight percent, followed by the addition of a silica/flocculent mixture consisting of 19.04 grams of Snowtex OL colloidal silica having a solids loading of 21 percent, 20 grams of Snowtex OS colloidal silica having a solids loading of 20.69, 1.2 grams of a polyaluminum chloride mixture and 10.8 grams of 0.02 molar nitric acid solution. 24 Grams of a flocculent mixture containing 2.4 grams of polyaluminum chloride mixture and 21.6 grams of 0.02 molar nitric acid solution were then added. Thereafter, the mixture was heated at 1° C. per minute to a temperature of 49° C. and held there for a period of about 1.5 to about 2 hours resulting in a volume average particle diameter of 5 microns as measured with a Coulter Counter. During heat up period, the stirrer was operated at about 250 rpm and 10 minutes after the set temperature of 49° C. was reached, the stirrer speed was reduced to about 220 rpm. An additional 138.5 grams of latex A were added to the reactor mixture and allowed to aggregate for an additional period of about 30 minutes at 49° C. resulting in a volume average particle diameter of about 5.7 microns. A basic solution of 4 percent NaOH in distilled water was then added to the toner mixture to increase the pH to 7. Thereafter, the reactor mixture was heated at 1° C. per minute to a temperature of 95° C., followed by adjusting the reactor mixture pH to 6 with 0.3 M nitric acid solution. Following this, the reactor mixture was gently stirred at 95° C. for 5 hours to enable the particles to coalesce and spheroidize. The reactor heater was then turned off and the reactor mixture was allowed to cool to room temperature at rate of 1° C. per minute. The toner of the resulting mixture comprises 81 percent of styrene/acrylate polymer, 5 percent of PB15:3 cyan pigment, 9 percent by weight of PW725 wax, 2 percent Snowtex OL colloidal silica, and 3 percent Snowtex OS colloidal silica, and had a volume average particle diameter of about 5.7 microns and a GSD of about 1.20. The toner was washed in a similar manner as indicated in Example I. The toner morphology was shown to be spherical in shape as determined by scanning electron microscopy. Aluminum analysis of the toner by ICP indicated an aluminum content of 608 ppm out of a starting amount of 952 ppm indicating that much of the aluminum was retained in the toner. The dry toner was fused on a free-belt nip fuser of the type currently used in the Xerox Corporation DocuColor 2240. The gloss attained was 46.1 GGU at a temperature of 160° C., as measured using a Gardner Gloss Meter at a 75° angle. The toner Minimum Fixing Temperature (MFT) was 130° C.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A toner process comprised of a first heating of a colorant dispersion, a latex emulsion, and a wax dispersion in the presence of a coagulant containing a metal ion; adding a silicate salt; followed by a second heating at a higher temperature than said first heating.

2. A toner process comprised of a first heating of a colorant dispersion, a latex emulsion, and a wax dispersion in the presence of a coagulant containing a metal ion; adding a silicate salt; followed by a second heating, and wherein said first heating enables toner aggregates, and said second heating provides coalesced toner particles, and wherein said first heating is below about the glass transition temperature of a polymer contained in said latex; and said second heating is above about the glass transition temperature of the polymer contained in said latex, and wherein said silicate salt is sodium silicate or potassium silicate.

3. A process in accordance with claim 2 wherein there is added to the formed aggregates said silicate salt of a sodium silicate dissolved in sodium hydroxide.

4. A process in accordance with claim 2 wherein the amount of silicate salt selected is from about 0.5 to about 2.5 parts per hundred by weight of toner, and wherein the silicate salt is dissolved in a base.

5. A process in accordance with claim 2 comprising (i) mixing said colorant dispersion containing pigment, water and an anionic surfactant, and wherein said wax dispersion added is comprised of submicron wax particles of from about 0.1 to about 0.5 micron in diameter by volume, and which wax is dispersed in water and an anionic surfactant to provide a mixture containing colorant, and a wax;

(ii) blending the resulting mixture of (i) with a first portion of said latex comprised of submicron substantially noncrosslinked polymer of about 150 to about 300 nanometers, and containing water and an anionic surfactant or a nonionic surfactant to provide a blend of colorant, wax and resin;

(iii) wherein the resulting blend possesses a pH of about 2.2 to about 2.8, and to which blend is added a coagulant;

(iv) heating the resulting mixture of (iii) below about the glass transition temperature (Tg) of the latex resin to form toner sized aggregates;

(v) adding to the formed toner aggregates a second portion of the latex (ii) comprised of polymer particles suspended in an aqueous phase containing an ionic surfactant and water;

(vi) adding to the resulting mixture of (v) an aqueous solution of a silicate salt dissolved in a base to thereby change the pH, which is initially from about 2 to about 2.8, to arrive at a pH of from about 7 to about 7.5;

(vii) heating the resulting aggregate mixture of (vi) above about the Tg of the polymer in said latex (ii) to accomplish fusion of said toner components;

(viii) optionally retaining the resulting mixture at a temperature of from about 85° C. to about 95° C. for an optional period of about 10 to about 60 minutes, followed by a pH reduction with an acid to arrive at a pH of about 3.8 to about 6;

(ix) washing the resulting toner slurry; and (x) isolating the toner product.

6. A process in accordance with claim 1 wherein the colorant dispersion contains a pigment in art amount of about 3 to about 10 percent by weight, said wax is selected in an amount of about 5 to about 15 percent by weight, said latex polymer is selected in an amount of about 80 to about 90 percent by weight of toner, said metal ion is aluminum present in an amount of from about 500 to about 1,000 parts per million (ppm), said coagulant is polyaluminum chloride present in an amount of from about 1,000 to about 2,000 parts per million; and wherein said silicate salt extracts said aluminum, and there results in said toner from about 50 to about 500 parts per million of said aluminum.

7. A process in accordance with claim 5 wherein said silicate reacts with aluminum contained in the toner aggregates resulting in the substantial extraction of said aluminum.

8. A process in accordance with claim 5 wherein the pH of (viii) is reduced to about 3.8 to about 6 or to about 4 to about 5.5 to assist coalescence of the polymer, colorant, and wax.

9. A process in accordance with claim 2 wherein said silicate salt is selected from the group consisting of sodium silicate ($Na_2O/SiO_2$) dissolved in sodium hydroxide, and potassium silicate ($K_2O/SiO_2$) dissolved in potassium hydroxide, and wherein said coagulant is a polymetal halide.

10. A process in accordance with claim 2 wherein said sodium silicate is $SiO_2$:$Na_2O$ of a weight ratio of about 1.6 to about 3.2.

11. A process in accordance with claim 2 wherein said silicate extracts from about 50 to about 98 percent of aluminum, Ca, Mn, Mg, Zn, Ni, or mixtures thereof.

12. A process in accordance with claim 1 wherein said coagulant is selected from the group consisting of polyaluminum chloride (PAC), polyaluminum sulfo silicate (PASS), aluminum sulfate, zinc sulfate, and magnesium sulfate in an amount of about 0.02 to about 3 pph by weight of toner.

13. A process in accordance with claim 1 wherein about 5 to about 50 percent of said coagulant is retained in said toner product, and optionally wherein an image developed with said toner possesses a gloss of about 90 to about 50 ggu.

14. A process in accordance with claim 1 wherein said colorant comprises particles of cyan, yellow, magenta, black, orange, red, green, or mixtures thereof dispersed in water and an anionic surfactant, and wherein said colorant is present in an amount of from about 4 to about 12 weight percent.

15. A process in accordance with claim 1 wherein said coagulant is a polymetal halide present in an amount of about 0.02 to about 3 percent by weight of toner.

16. A process in accordance with claim 1 wherein the coagulant is a polymetal halide selected in an amount of about 0.05 to about 0.5 percent by weight of toner.

17. A process in accordance with claim 5 (viii) wherein said acid is nitric, sulfuric, hydrochloric, citric or acetic acid.

18. A process in accordance with claim 5 wherein there is added to the formed toner aggregates of (v) said second portion of said latex comprised of submicron resin particles suspended in an aqueous phase containing an anionic surfactant, and wherein said second latex is selected in an amount of from about 10 to about 40 percent by weight of the initial latex (i) to form a shell thereover on said formed aggregates, and which shell is of an optional thickness of about 0.2 to about 0.8 micron.

19. A process in accordance with claim 5 wherein said added latex contains the same polymer as the initial latex of (i), or wherein said added latex contains a dissimilar polymer than that of the initial latex.

20. A process in accordance with claim 5 wherein the pH of the mixture resulting in (vi) is increased from about 2 to about 2.6 to about 7 to about 7.4, and wherein said silicate salt dissolved in a base functions primarily as a stabilizer for the aggregates during coalescence (vii), and no or minimal toner particle size increase results, and wherein said coagulant is a polymetal halide.

21. A process in accordance with claim 5 wherein the aggregation temperature (iv) is from about 45° C. to about 60° C., and wherein the coalescence or fusion temperature of (vii) and (viii) is from about 80° C. to about 95° C.

22. A process in accordance with claim 5 wherein the time of coalescence or fusion of (vii) is from about 3 to about 6 hours, and wherein the toner resulting possesses a smooth morphology.

23. A process in accordance with claim 1 wherein said latex contains a polymer selected from the group comprised of poly(styrene-alkyl acrylate), poly(styrene-1,3-diene), poly(styrene-alkyl methacrylate), poly(alkyl methacrylate-alkyl acrylate), poly(alkyl methacrylate-aryl acrylate), poly (aryl methacrylate-alkyl acrylate), poly(alkyl methacrylate), poly(styrene-alkyl acrylate-acrylonitrile) poly(styrene-1,3-diene-acrylonitrile), poly(alkyl acrylate-acrylonitrile), poly (styrene-butadiene), poly(methylstyrene-butadiene), poly (methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylonitrile), and poly(styrene-butyl acrylate-acrylononitrile).

24. A process in accordance with claim 1 wherein said latex contains a polymer with a carboxylic acid selected from the group comprised of acrylic acid, methacrylic acid, itaconic acid, beta carboxy ethyl acrylate, fumaric acid, maleic acid, and cinnamic acid, and wherein carboxylic acid is selected in an amount of from about 0.1 to about 10 weight percent.

25. A process in accordance with claim 1 wherein said wax dispersion contains a polyethylene, a polypropylene wax, or mixtures thereof, water, and an anionic surfactant, and wherein said wax is selected in an amount of from about 5about 20 weight percent.

26. A process comprising heating a mixture of colorant dispersion, a resin latex, and a coagulant, and wherein said heating involves a first heating and subsequently a second heating, and which second heating is at a higher temperature than said first heating, and wherein said second heating is above about the glass transition temperature of said resin, and which process is accomplished in the presence of a silicate salt.

27. A process in accordance with claim 26 wherein said latex polymer possesses a molecular weight $M_w$ of about 20,000 to about 500,000, and an onset glass transition (Tg) temperature of from about 45° C. to about 55° C.

28. A process in accordance with claim 26 wherein said latex resin is selected in an amount of from about 65 to about 85 weight percent, further adding a wax selected in an amount of from about 5 to about 15 weight percent, and said colorant is selected in the amount of 3 to about 15 percent, and wherein the total thereof of said components is about 100 percent based on said toner.

29. A process in accordance with claim 26 wherein said resulting toner possesses a shape factor of from about 120 to about 148.

30. A process in accordance with claim 26 wherein said silicate salt extracts from about 50 to about 98 percent of ions of Al, Ca, Mn, Mg, Zn, Ni or mixtures thereof.

31. A process comprising heating a mixture of colorant and latex in the presence of a coagulant and a silicate salt, and wherein said heating comprises a first heating equal to or below about the glass transition temperature of a polymer contained in said latex, and a second heating equal to or about the glass transition temperature of a polymer contained in said latex; wherein said first heating enables the formation of aggregates and said second heating enables the fusion of said colorant and said polymer; and optionally wherein said silicate is contained in an alkali metal hydroxide.

32. A toner process comprised of a first heating of a colorant dispersion, a latex emulsion, and a wax dispersion in the presence of a coagulant containing a metal ion; adding a silicate salt; followed by a second heating, and wherein said first heating enables toner aggregates, and said second heating provides coalesced toner particles, and wherein said first heating is below about the glass transition temperature of a polymer contained in said latex; and said second heating is above about the glass transition temperature of the polymer contained in said latex, and wherein said latex contains a polymer optionally selected from the group comprised of poly(styrene-alkyl acrylate), poly(styrene-1,3-diene), poly (styrene-alkyl methacrylate), poly(alkyl methacrylate-alkyl acrylate), poly(alkyl methacrylate-aryl acrylate), poly(aryl methacrylate-alkyl acrylate), poly(alkyl methacrylate), poly (styrene-alkyl acrylate-acrylonitrile), poly(styrene-1,3-diene-acrylonitrile), poly(alkyl acrylate-acrylonitrile), poly (styrene-butadiene), poly(methylstyrene-butadiene), poly (methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylonitrile), and poly(styrene-butyl acrylate-acrylononitrile).

* * * * *